US006394202B2

(12) United States Patent
Truax et al.

(10) Patent No.: US 6,394,202 B2
(45) **Date of Patent: *May 28, 2002**

(54) DRILL BIT HAVING DIAMOND IMPREGNATED INSERTS PRIMARY CUTTING STRUCTURE

(75) Inventors: David K. Truax, Houston; Thomas Walter Oldham, The Woodlands; Carl Edward Penuel, Houston; Duane R. Van Waes, Cypress, all of TX (US)

(73) Assignee: Smith International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,968

(22) Filed: Jun. 30, 1999

(51) Int. Cl.[7] ..... E21B 10/46; E21B 10/50; E21B 10/52

(52) U.S. Cl. ..... 175/434; 175/426; 175/428; 175/435

(58) Field of Search ..... 175/426, 428, 175/434, 435

(56) References Cited

U.S. PATENT DOCUMENTS

| | | | | |
|---|---|---|---|---|
| 3,696,875 A | | 10/1972 | Cortes | 175/329 |
| 4,128,136 A | | 12/1978 | Generoux | 175/330 |
| 4,234,048 A | | 11/1980 | Rowley | 175/329 |
| 4,718,505 A | | 1/1988 | Fuller | 175/329 |
| 4,823,892 A | | 4/1989 | Fuller | 175/329 |
| 4,889,017 A | | 12/1989 | Fuller et al. | 76/108 |
| 4,940,099 A | * | 7/1990 | Deane et al. | 175/374 |
| 4,976,324 A | | 12/1990 | Tibbitts | 175/329 |
| 4,991,670 A | | 2/1991 | Fuller et al. | 175/329 |
| 5,147,001 A | * | 9/1992 | Chow et al. | 175/428 |
| 5,265,685 A | | 11/1993 | Keith et al. | 175/431 |
| 5,433,280 A | * | 7/1995 | Smith | 175/336 |
| 5,590,727 A | * | 1/1997 | Tank et al. | 175/374 |
| 5,655,612 A | | 8/1997 | Grimes et al. | 175/401 |
| 5,720,357 A | * | 2/1998 | Fuller et al. | 175/428 |
| 5,912,217 A | * | 6/1999 | Sumiya et al. | 51/307 |

FOREIGN PATENT DOCUMENTS

| | | | |
|---|---|---|---|
| EP | 0492457 | 12/1991 | E21B/10/56 |
| GB | 2190120 | 5/1986 | E21B/10/46 |
| GB | 2246378 | 6/1991 | E21B/10/56 |
| GB | 2 299 111 | 9/1996 | E21B/10/46 |
| WO | WO 95/33911 | 12/1995 | E21B/10/46 |

OTHER PUBLICATIONS

U.K. Search Report.

* cited by examiner

*Primary Examiner*—David Bagnell
*Assistant Examiner*—Jennifer M Gay
(74) *Attorney, Agent, or Firm*—Conley, Rose & Tayon, P.C.

(57) ABSTRACT

An earth-boring bit comprises a bit body bit body in which are mounted a plurality of cutting structures inserts, wherein at least a portion of the cutting structures comprise diamond-impregnated inserts having a total thermal exposure of less than 25 minutes above 1500° F. The diamonds can be natural or synthetic diamond. The bit body itself may be diamond-impregnated, in which case it is preferred that the diamonds in the inserts make up at least 40% of the total diamond in the bit.

27 Claims, 3 Drawing Sheets

FIG.2
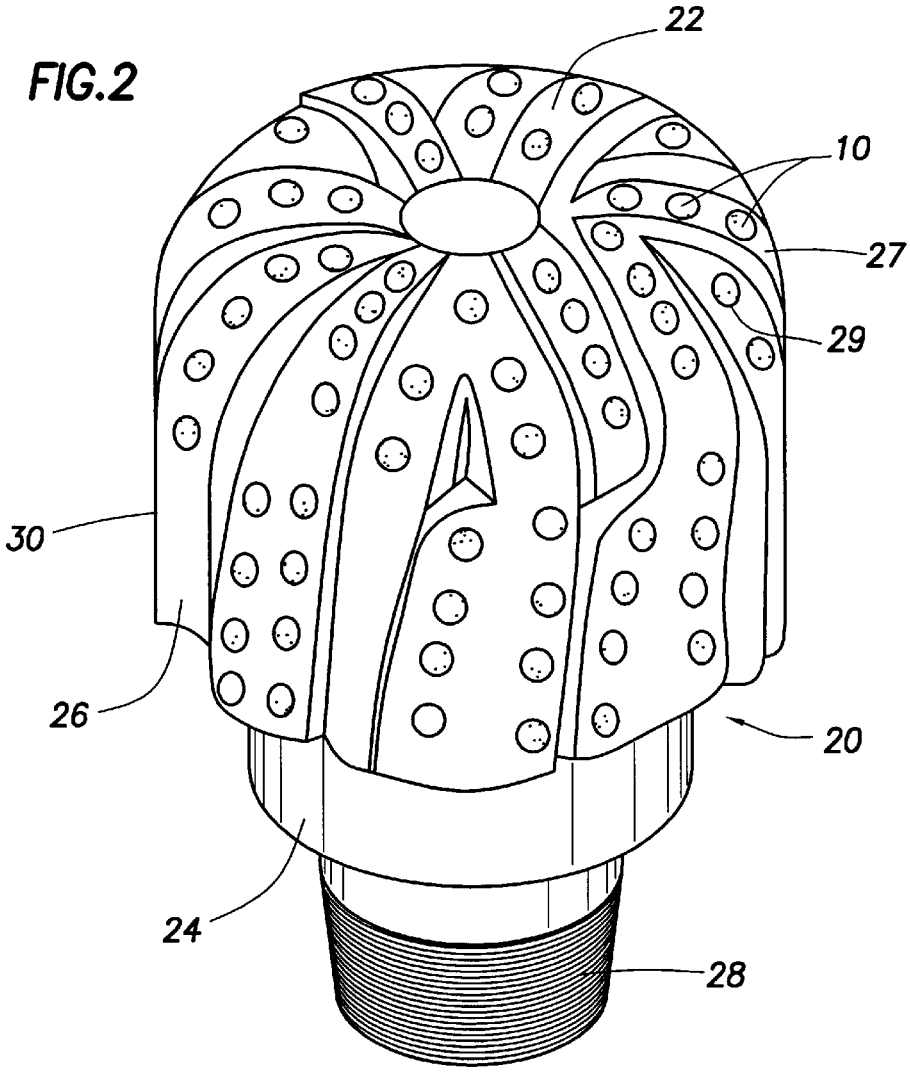
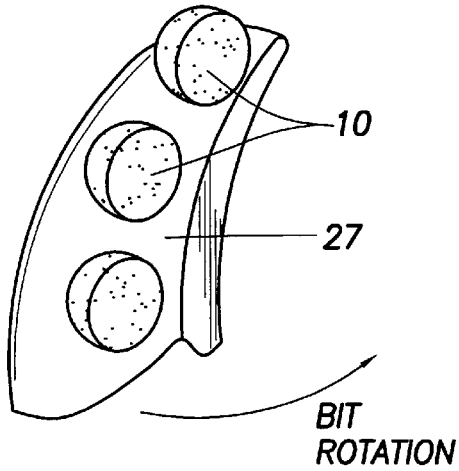
FIG.3

DRILL BIT HAVING DIAMOND IMPREGNATED INSERTS PRIMARY CUTTING STRUCTURE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates generally to drill bits used in the oil and gas industry and more particularly, to drill bits having diamond-impregnated cutting surfaces. Still more particularly, the present invention relates to drag bits in which the diamond particles imbedded in the cutting surface have not suffered the deleterious thermal exposure that is normally associated with the manufacture of such bits.

BACKGROUND OF THE INVENTION

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in that the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

During abrasive drilling with a diamond-impregnated cutting structure, the diamond particles scour or abrade away concentric grooves while the rock formation adjacent the grooves is fractured and removed. As the matrix material around the diamond granules is worn away, the diamonds at the surface eventually fall out and other diamond particles are exposed.

To form a diamond-impregnated bit, the diamond, which is available in a wide variety of shapes and grades, is placed in predefined locations in a bit mold. Alternatively, composite components, or segments comprising diamond particles in a matrix material such as tungsten carbide/cobalt (WC—Co) can be placed in predefined locations in the mold. Once the diamond-containing components have been positioned in the mold, other components of the bit are positioned in the mold. Specifically, the steel shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for on the order of 0.75 to 2.5 hours, depending on the size of the bit body, during the infiltration process. By this process, a monolithic bit body that incorporates the desired components is formed. It has been found, however, that the life of both natural and synthetic diamond is shortened by the lifetime thermal exposure experienced in the furnace during the infiltration process. Hence it is desired to provide a technique for manufacturing bits that include imbedded diamonds than have not suffered the thermal exposure that is normally associated with the manufacture of such bits.

Another type of bit is disclosed in U.S. Pat. Nos. 4,823,892, 4,889,017, 4,991,670 and 4,718,505, in which diamond-impregnated abrasion elements are positioned behind the cutting elements in a conventional tungsten carbide (WC) matrix bit body. The abrasion elements are not the primary cutting structures during normal bit use. Hence, it is further desired to provide a bit that includes diamond particles in its primary or leading cutting structures without subjecting the diamond particles to undue thermal stress or thermal exposure.

BRIEF SUMMARY OF THE INVENTION

The present invention provides a bit with cutting structures that include diamond particles, in which a portion of the diamond particles have not been subjected to undue amounts of thermal stress or thermal exposure. Specifically, the present invention comprises a bit that includes diamond-impregnated inserts as the cutting structures on at least one blade of the bit. The diamond-impregnated inserts are manufactured separately from the bit body. Once formed, the diamond-impregnated inserts are affixed to the bit body by brazing or other means of attachment. The total thermal exposure of the diamond particles during manufacture in accordance with the present invention is significantly lower than the total manufacturing-related thermal exposure in previously known diamond-impregnated cutting structures. Thus, the operating life of the cutting structures, and therefore the life of the bit itself, is increased.

BRIEF DESCRIPTION OF THE DRAWINGS

For an introduction to the detailed description of the preferred embodiments of the invention, reference will now be made to the accompanying drawings, wherein:

FIG. 2 is a perspective view of an earth-boring bit made in accordance with the principles of the present invention;

FIG. 3 is a perspective view of a alternative embodiment of an earth-boring bit made in accordance with the principles of the present invention.

DETAILED DESCRIPTION OF THE INVENTION

According to a preferred embodiment, diamond-impregnated inserts that will comprise the cutting structure of a bit are formed separately from the bit. Because the inserts are smaller than a bit body, they can be hot pressed or sintered for a much shorter time than is required to infiltrate a bit body.

Figure 1:
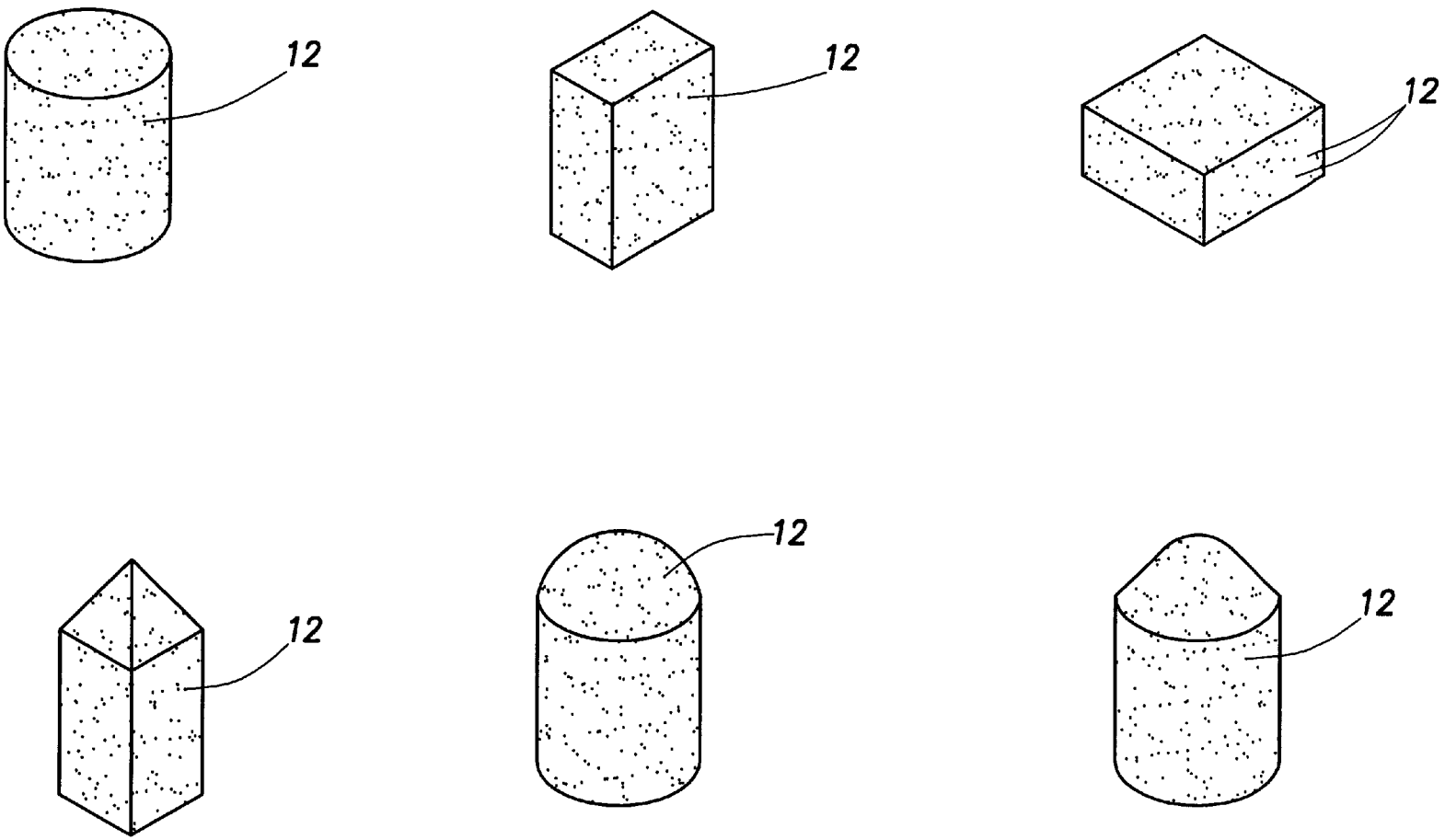
FIG. 1 shows a variety of possible configurations for a diamond-impregnated insert in accordance with the present invention.

In the preferred embodiment of the invention, the diamond-impregnated inserts 10 are manufactured as individual components, as indicated in FIG. 1. According to one preferred embodiment, diamond particles 12 and powdered matrix material are placed in a mold. The contents are then hot-pressed or sintered at an appropriate temperature, preferably between about 1000 and 2200° F., more preferably below 1800° F., to form a composite insert. Heating of the material can be by furnace or by electric induction heating, such that the heating and cooling rates are rapid and controlled in order to prevent damage to the diamonds.

If desired, a very long cylinder having the outside diameter of the ultimate insert shape can be formed by this process and then cut into lengths to produce diamond-impregnated inserts 10 having the desired length. The dimensions and shape of the diamond-impregnated inserts 10 and of their positioning on the bit can be varied, depending on the nature of the formation to be drilled.

The diamond particles can be either natural or synthetic diamond, or a combination of both. The matrix in which the diamonds are embedded to form the diamond impregnated inserts 10 must satisfy several requirements. The matrix must have sufficient hardness so that the diamonds exposed at the cutting face are not pushed into the matrix material under the very high pressures used in drilling. In addition, the matrix must have sufficient abrasion resistance so that the diamond particles are not prematurely released. Lastly, the heating and cooling time during sintering or hot-pressing, as well as the maximum temperature of the thermal cycle, must be sufficiently low that the diamonds imbedded therein are not thermally damaged during sintering or hot-pressing.

To satisfy these requirements, the following materials may be used for the matrix in which the diamonds are embedded: tungsten carbide (WC), tungsten alloys such as tungsten/cobalt alloys (WC—Co), and tungsten carbide or tungsten/cobalt alloys in combination with elemental tungsten (all with an appropriate binder phase to facilitate bonding of particles and diamonds) and the like.

Referring now to FIG. 2, a drill bit 20 according to the present invention comprises a shank 24 and a crown 26. Shank 24 is typically formed of steel and includes a threaded pin 28 for attachment to a drill string. Crown 26 has a cutting face 22 and outer side surface 30. According to one preferred embodiment, crown 26 is formed by infiltrating a mass of tungsten-carbide powder impregnated with synthetic or natural diamond, as described above. Crown 26 may include various surface features, such as raised ridges 27. Preferably, formers are included during the manufacturing process, so that the infiltrated, diamond-impregnated crown includes a plurality of holes or sockets (FIGS. 2, 29) that are sized and shaped to receive a corresponding plurality of diamond-impregnated inserts 10. Once crown 26 is formed, inserts 10 are mounted in the sockets and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 29 can be inclined with respect to the surface of the crown. In this embodiment, the sockets are inclined such that inserts 10 are oriented substantially in the direction of rotation of the bit, so as to enhance cutting.

As a result of the present manufacturing technique, each diamond-impregnated insert is subjected to a total thermal exposure that is significantly reduced as compared to previously known techniques for manufacturing infiltrated diamond-impregnated bits. For example, diamonds imbedded according to the present invention have a total thermal exposure of less than 40 minutes, and more typically less than 20 minutes, above 1500° F. This limited thermal exposure is due to the hot pressing period and the brazing process. This compares very favorably with the total thermal exposure of at least about 45 minutes, and more typically about 60–120 minutes, at temperatures above 1500° F., that occur in conventional manufacturing of furnace-infiltrated, diamond-impregnated bits. If the present diamond-impregnated inserts are affixed to the bit body by adhesive or by mechanical means such as interference fit, the total thermal exposure of the diamonds is even less.

Figure 4:
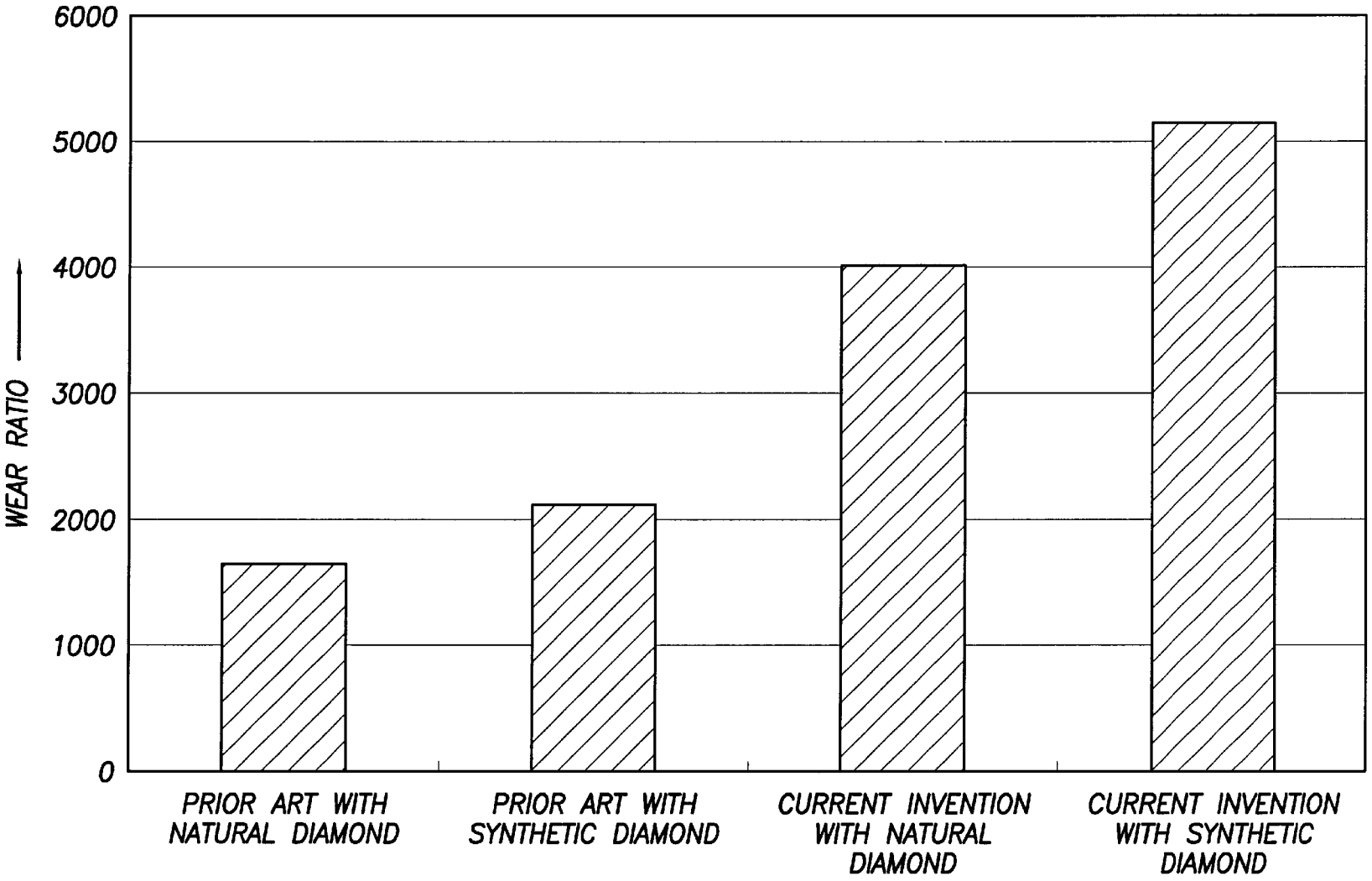
FIG. 4 is a plot showing a comparison of the wear ratios for inserts constructed according to the present invention to prior art diamond-impregnated bits.

Referring now to FIG. 4, a plot of the wear resistance as measured for each of several insert types shows the superiority of inserts according to the present invention. The wear ratio is defined as the ratio of the volume of rock removed to the volume of the insert worn during a given cutting period. Thus, a higher wear ratio is more desirable than a lower wear ratio. Column 1 indicates the wear ratio for natural diamond impregnated into a matrix in a conventional manner, i.e. placed in the mold before furnace infiltration of the bit and subjected to a conventional thermal history. Column 2 indicates the wear ratio for synthetic diamond, also impregnated into a matrix in a conventional manner. Columns 3 and 4 indicate the wear ratios for natural diamond and synthetic diamond, respectively, impregnated into inserts and brazed into a bit body and thereby subjected to a thermal history in accordance with the present invention. It can be clearly seen that cutting structures constructed according to the present invention have wear ratios that are at least two, and often three or more times greater than conventional diamond-impregnated cutting structures.

In the present invention, at least about 15%, more preferably about 30%, and still more preferably about 40% of the diamond volume in the entire cutting structure is present in the inserts, with the balance of the diamond being present in the bit body. However, because the diamonds in the inserts have 2–3 times the rock cutting life of the diamonds in the bit body, in a preferred embodiment the inserts provide about 57% to about 67% of the available wear life of the cutting structure. It will further be understood that the concentration of diamond in the inserts can vary from the concentration of diamond in the bit body. According to a preferred embodiment, the concentrations of diamond in the inserts and in the bit body are in the range of 50 to 100 (100=4.4 carat/cc$^3$).

It will be understood that the materials commonly used for construction of bit bodies can be used in the present invention. Hence, in the preferred embodiment, the bit body may itself is diamond-impregnated. In an alternative embodiment, the bit body comprises infiltrated tungsten carbide matrix that does not include diamond.

In another alternative embodiment, the bit body can be made of steel, according to techniques that are known in the art. Again, the final bit body includes a plurality of holes having a desired orientation, which are sized to receive and support diamond-impregnated inserts 10. Inserts 10 are affixed to the steel body by brazing, mechanical means, adhesive or the like. The bit according to this embodiment can optionally be provided with a layer of hardfacing.

In still another embodiment, one or more of the diamond-impregnated inserts include imbedded thermally stable polycrystalline diamond (also known as TSP), so as to enhance shearing of the formation. The TSP can take any desired form, and is preferably formed into the insert during the insert manufacturing process. Similarly, additional primary and/or secondary cutting structures that are not diamond-impregnated can be included on the bit, as may be desired.

The present invention allows bits to be easily constructed having inserts in which the size, shape, and/or concentration of diamond in the cutting structure is controlled in a desired manner. Likewise, the inserts can be created to have different lengths, or mounted in the bit body at different heights or angles, so as to produce a bit having a multiple height cutting structure. This may provide advantages in drilling efficiency. For example, a bit having extended diamond-impregnated inserts as a cutting structure will be able to cut through downhole float equipment that could not be cut by a standard diamond-impregnated bit, thereby eliminating the need to trip out of the hole to change bits. Additionally, a bit having such extended diamond-impregnated inserts will be able to drill sections of softer formations that would not be readily drillable with conventional diamond-impregnated bits. This is made possible by the shearing action of the inserts that extend beyond the surface of the bit body.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims. In any method claim, the recitation of steps in a particular order is not intended to limit the scope of the claim to the performance of the steps in that order unless so stated.

What is claimed is:

1. A diamond-impregnated earth-boring bit, comprising:

a bit body, at least a portion of said body being diamond impregnated and containing a first diamond volume and a plurality of inserts affixed to said bit body, at least one of said inserts being diamond impregnated and containing a second diamond volume wherein the total exposure of said first diamond volume to temperatures above 1000° F. is greater than the total exposure of said second diamond volume to temperatures above 1000° F.

2. The bit according to claim 1 wherein said first diamond volume has a total thermal exposure of more than 40 minutes above 1500° F. prior to use of the bit.

3. The bit according to claim 1 wherein said second diamond volume has a total thermal exposure of less than 40 minutes above 1500° F. prior to use of the bit.

4. The bit according to claim 1 wherein said second diamond volume has a total thermal exposure of less than 20 minutes above 1500° F. prior to use of the bit.

5. The bit according to claim 1 wherein said second diamond volume has a total thermal exposure of less than 30 minutes above 1000° F. prior to use of the bit.

6. The bit according to claim 1 wherein said second diamond volume is at least as great as said first diamond volume.

7. The bit according to claim 1 wherein said second diamond volume comprises at least 15% of the total diamond volume in the bit.

8. The bit according to claim 1 wherein at least one said diamond-impregnated insert includes thermally stable polycrystalline diamond material.

9. The bit according to claim 1 wherein the bit body comprises infiltrated diamond-impregnated tungsten carbide matrix.

10. The bit according to claim 1 wherein each diamond-impregnated insert is affixed to the bit body by brazing.

11. The bit according to claim 1 wherein each diamond-impregnated insert is affixed to the bit body by an adhesive.

12. The bit according to claim 1 wherein each diamond-impregnated insert is affixed to the bit body by mechanical means.

13. The bit according to claim 1, further including at least one additional cutting element that is not diamond-impregnated.

14. The bit according to claim 1, further including at least one secondary cutting element.

15. A method for forming a bit having a diamond-impregnated cutting structure, comprising:

(a) forming a plurality of diamond-impregnated inserts comprising diamond particles in a first matrix creating a second diamond volume;

(b) forming a diamond-impregnated bit body having a first diamond volume and including in the formed bit body a plurality of sockets sized to receive the inserts; and (c) mounting the inserts in the bit body and affixing the inserts to the bit body; wherein steps (a)–(c) are carried out such that the total exposure of the first diamond volume to temperatures above 1000° F. is greater than the total exposure of the second diamond volume to temperatures above 1000° F.

16. The bit according to claim 15 wherein steps (a)–(c) are carried out without subjecting the diamond particles in each insert to more than 40 minutes above 1500° F.

17. The bit according to claim 15 wherein steps (a)–(c) are carried out without subjecting the diamond particles in each insert to more than 20 minutes above 1500° F.

18. The bit according to claim 15 wherein steps (a)–(c) are carried out without subjecting the diamond particles in each insert to more than 30 minutes above 1000° F.

19. The bit according to claim 15 wherein step (a) includes incorporating particles of a thermally stable polycrystalline material in at least one diamond-impregnated insert.

20. The bit according to claim 15 wherein step (b) includes forming the bit body as an infiltrated tungsten carbide matrix.

21. The bit according to claim 15 wherein the diamond particles in the inserts include at least 40% of the total diamond in the bit.

22. The bit according to claim 15 wherein step (c) includes affixing each diamond-impregnated insert to the bit body by brazing.

23. The bit according to claim 15 wherein step (c) includes affixing each diamond-impregnated insert to the bit body by an adhesive.

24. The bit according to claim 15 wherein step (c) includes affixing each diamond-impregnated insert to the bit body by a mechanical means.

25. A diamond-impregnated earth-boring bit, comprising;

a bit body having integral blades, said blades including a first diamond volume; and a plurality of inserts affixed to the bit body, wherein at least one of said inserts is diamond-impregnated and contains a second diamond volume;

wherein the total exposure of said first diamond volume to temperatures above 1000° F. is greater than the total exposure of said second diamond volume to temperatures above 1000° F.

26. The bit according to claim 25 wherein said blade is diamond-impregnated.

27. The bit according to claim 25 wherein at least one primary cutting structure comprises a diamond-impregnated insert having a total thermal exposure of less than 40 minutes above 1500° F.

* * * * *